US012566049B2

(12) United States Patent
LeMarbe

(10) Patent No.: US 12,566,049 B2
(45) Date of Patent: Mar. 3, 2026

(54) BODY ARMOR SYSTEM

(71) Applicant: Point Blank Enterprises, Inc., Pompano Beach, FL (US)

(72) Inventor: Randall Jered LeMarbe, Pompano Beach, FL (US)

(73) Assignee: Point Blank Enterprises, Inc., Pompano Beach, FL (US)

( * ) Notice: Subject to any disclaimer, the term of this patent is extended or adjusted under 35 U.S.C. 154(b) by 49 days.

(21) Appl. No.: 18/488,097

(22) Filed: Oct. 17, 2023

(65) Prior Publication Data

US 2024/0247915 A1 Jul. 25, 2024

Related U.S. Application Data

(63) Continuation-in-part of application No. 17/737,202, filed on May 5, 2022, now Pat. No. 12,313,380.

(60) Provisional application No. 63/184,603, filed on May 5, 2021.

(51) Int. Cl.
*F41H 1/02* (2006.01)

(52) U.S. Cl.
CPC ..... *F41H 1/02* (2013.01)

(58) Field of Classification Search
CPC ..... F41H 1/02; A41D 13/0005
See application file for complete search history.

(56) References Cited

U.S. PATENT DOCUMENTS 1,489,048 A * 4/1924 Whitley ..... A63B 71/12 2/92
3,431,560 A * 3/1969 Austin ..... A63B 71/12 2/465
3,981,027 A * 9/1976 Anderson ..... A63B 71/12 2/462
5,060,314 A * 10/1991 Lewis ..... A62B 17/003 2/2.5
6,185,738 B1 * 2/2001 Sidebottom ..... F41H 1/02 2/2.5
7,765,624 B1 * 8/2010 Larson ..... A41D 27/26 2/459

(Continued)

FOREIGN PATENT DOCUMENTS

GB 2315984 A * 2/1998 ..... A41D 13/00
WO WO-2007146810 A2 * 12/2007 ..... A41D 13/0002

(Continued)

*Primary Examiner* — Khaled Annis
(74) *Attorney, Agent, or Firm* — Geoffrey Lottenberg; Berger Singerman LLP

(57) ABSTRACT

An armor carrier comprises a plate bag removably attachable to a soft armor carrier. The soft armor carrier comprises at least one panel and, in some cases, a front panel, a rear panel, and a pair of shoulder straps. The pair of shoulder straps may include one or more spaced-apart slit openings in a patterned configuration, and the front and rear panels of the soft armor carrier include one or more spaced-apart slit openings in a horizontal or vertical orientation. The plate bag, which comprises a front panel, a rear panel, and a pair of shoulder straps corresponding with respective components of the soft armor carrier, is donned over the soft armor carrier. The plate bag is removably secured to the soft armor carrier via one or more attachment fittings disposed on the plate bag that respectively engage the one or more of slit openings on the soft armor carrier.

30 Claims, 18 Drawing Sheets

(56) References Cited

U.S. PATENT DOCUMENTS 9,144,255 B1 * 9/2015 Perciballi ..... A41D 27/00
9,777,997 B2 * 10/2017 Swan ..... A41D 13/0518
10,098,441 B1 * 10/2018 Holloman ..... A45F 3/047
10,130,190 B2 * 11/2018 Workman ..... A47D 13/025
10,271,663 B2 * 4/2019 Salazar ..... A47D 13/025
10,274,289 B1 * 4/2019 Barnhart, II ..... F41H 1/02
10,455,869 B1 * 10/2019 Dille ..... F41H 1/02
10,485,272 B2 * 11/2019 Blauer ..... A41D 27/02
10,517,336 B2 * 12/2019 Monica ..... A41D 13/015
10,582,731 B2 * 3/2020 Williams ..... B32B 5/028
10,646,769 B1 * 5/2020 Farris ..... A41D 13/0015
10,893,708 B1 * 1/2021 Burnsed, Jr. ..... A41D 1/04
11,192,018 B2 * 12/2021 Monica ..... A63B 71/12
11,272,751 B2 * 3/2022 Popejoy ..... A42B 3/08
11,330,894 B2 * 5/2022 Rushing ..... A45F 4/02
11,385,028 B1 * 7/2022 LeMarbe ..... A41D 13/0005
2002/0120973 A1 * 9/2002 D'Annunzio ..... F41H 1/02 2/92
2004/0205881 A1 * 10/2004 Morrow ..... A41D 13/0518 2/459
2005/0086728 A1 * 4/2005 Tobergte ..... A63B 71/12 2/459
2005/0166303 A1 * 8/2005 Aaron ..... A63B 71/10 2/2.5
2006/0143771 A1 * 7/2006 Winkle ..... F41H 1/02 2/69
2007/0028339 A1 * 2/2007 Carlson ..... F41H 1/02 2/2.5
2008/0134419 A1 * 6/2008 Kalaam ..... F41H 1/02 2/2.5
2008/0313793 A1 * 12/2008 Skottheim ..... A41D 13/0531 2/463
2009/0211000 A1 * 8/2009 Roux ..... F41H 1/02 2/2.5
2009/0282595 A1 * 11/2009 Branson ..... F41H 1/02 2/2.5
2011/0004968 A1 * 1/2011 Morgan ..... B63C 9/135 2/2.5
2012/0174273 A1 * 7/2012 Frost ..... F41H 1/02 2/2.5
2012/0180178 A1 * 7/2012 Gallo ..... F41H 1/02 2/2.5
2013/0139287 A1 * 6/2013 Dovner ..... F41H 1/02 2/2.5
2014/0196203 A1 * 7/2014 Cole ..... F41H 1/02 24/305
2014/0259249 A1 * 9/2014 Milligan ..... F41H 1/02 2/2.5
2015/0211829 A1 * 7/2015 Cole ..... F41H 1/02 2/463
2015/0247705 A1 * 9/2015 Martinez ..... A41D 13/0153 2/2.5
2015/0282536 A1 * 10/2015 Kumuchian ..... A41D 13/0525 2/463
2015/0369567 A1 * 12/2015 Hall ..... F41H 1/02 89/36.05
2016/0033235 A1 * 2/2016 Kinnings ..... A45F 3/12 2/102
2016/0187103 A1 * 6/2016 Coats ..... G01N 3/313 2/2.5
2016/0238347 A1 * 8/2016 Blauer ..... A41D 3/005
2016/0316830 A1 * 11/2016 Roque ..... A41D 27/28
2017/0082404 A1 * 3/2017 Blauer ..... F41H 1/02
2017/0307335 A1 * 10/2017 Skifstad ..... F41C 33/041
2018/0058818 A1 * 3/2018 Beck ..... F41H 1/02
2018/0180387 A1 * 6/2018 Caballero ..... F41H 1/02
2020/0248989 A1 * 8/2020 Swan ..... F41H 1/02
2020/0300582 A1 * 9/2020 Becker ..... A41D 13/0012
2021/0330060 A1 * 10/2021 Miller ..... F41H 1/02
2023/0079499 A1 * 3/2023 Postolek ..... A44B 18/0073 2/270
2023/0160668 A1 * 5/2023 Groat ..... F41H 5/0478 89/36.05
2024/0247915 A1 * 7/2024 LeMarbe ..... F41H 1/02

FOREIGN PATENT DOCUMENTS

WO WO-2012113875 A1 * 8/2012 ..... F41H 1/02
WO WO-2017086800 A1 * 5/2017 ..... F41H 1/02

* cited by examiner

BODY ARMOR SYSTEM

CROSS REFERENCE TO RELATED APPLICATIONS

This application is a continuation-in-part of U.S. Non-provisional application Ser. No. 17/737,202, filed on May 5, 2022, and claims benefit of U.S. Provisional Application No. 63/184,603 filed on May 5, 2021, all of which are incorporated by reference herein.

Figure 1:
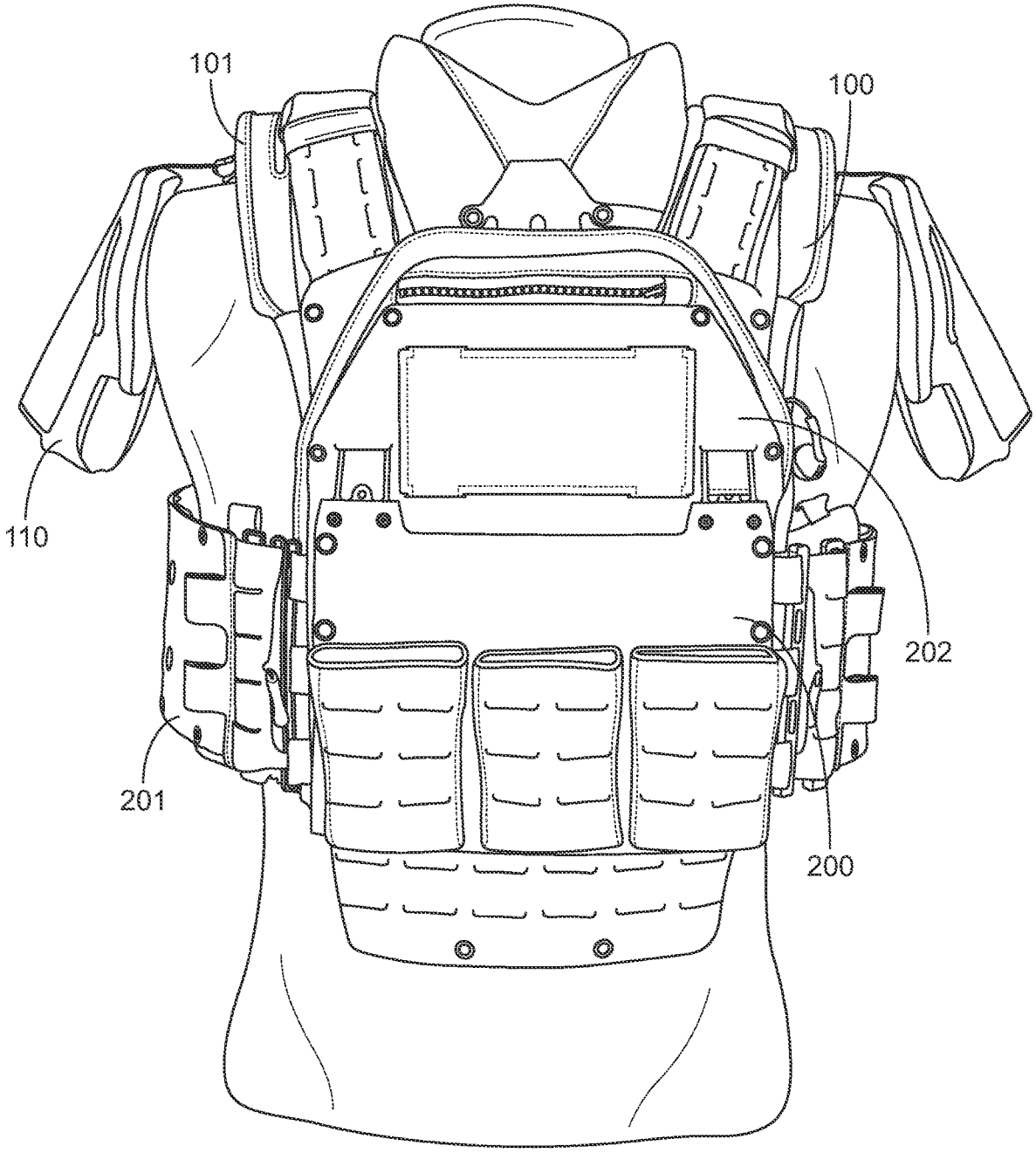
FIG. 1 is a front view of the body armor system.
Figure 2:
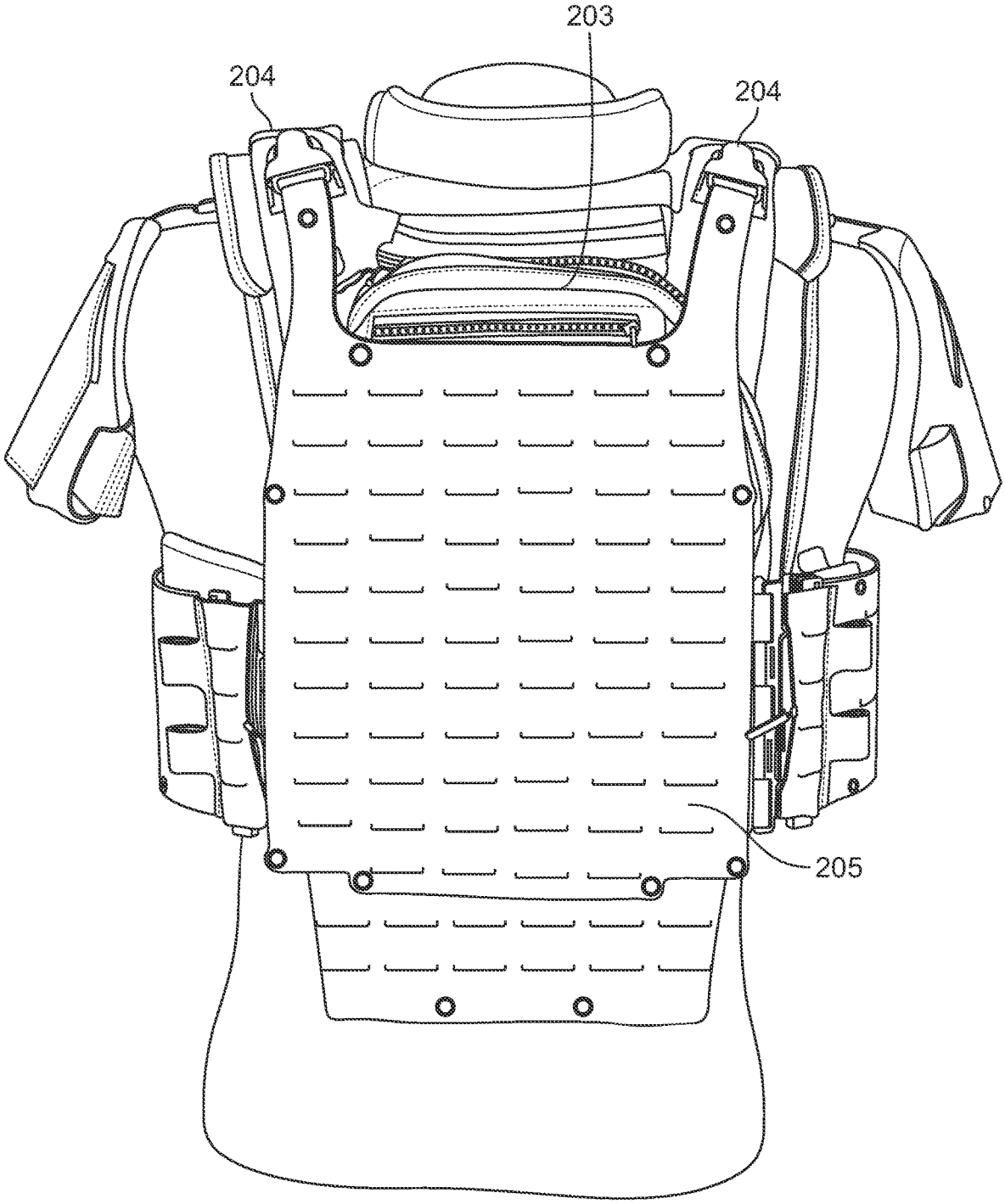
FIG. 2 is a rear view of the body armor system.
Figure 3:
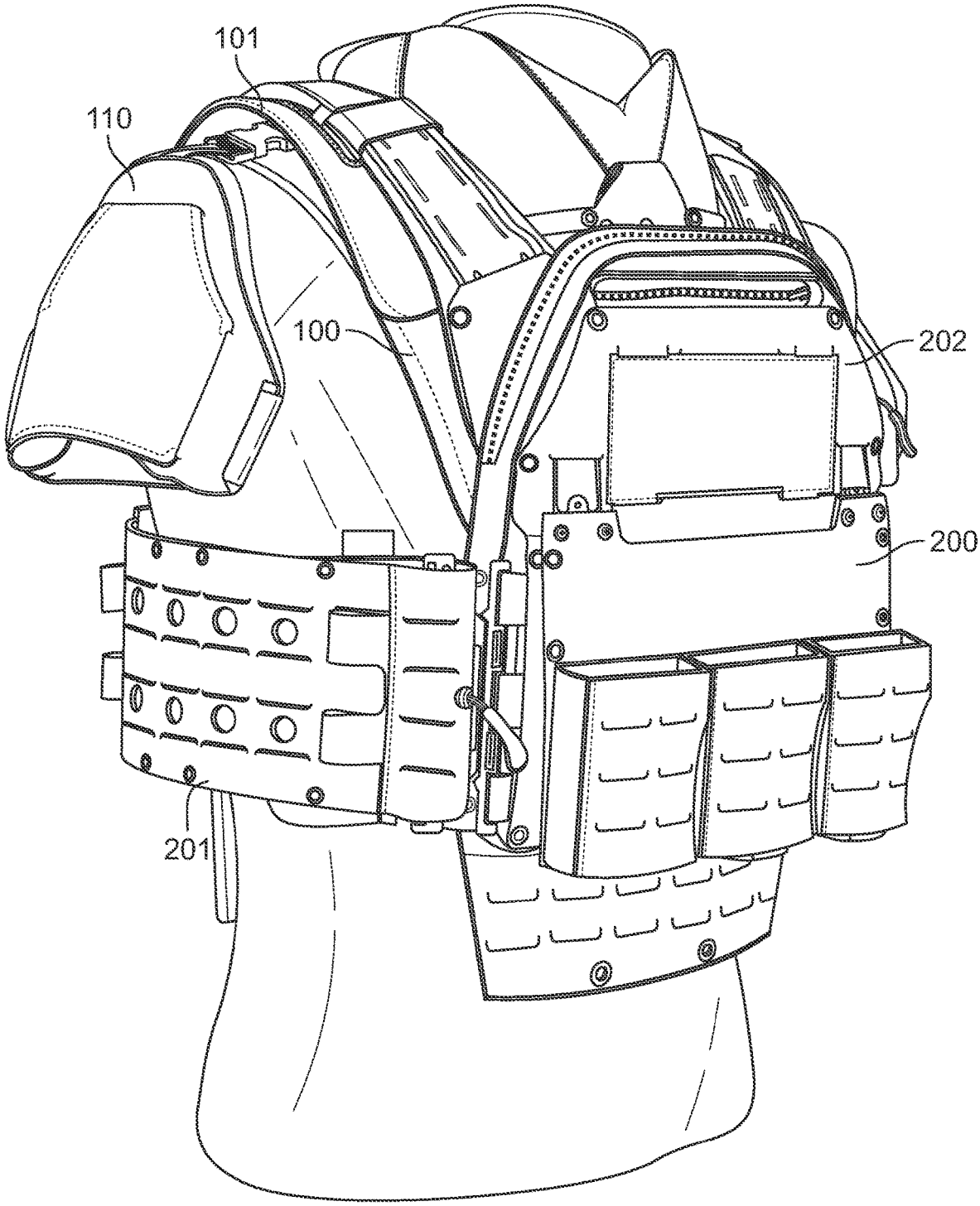
FIG. 3 is a front isometric view of the body armor system.
Figure 4:
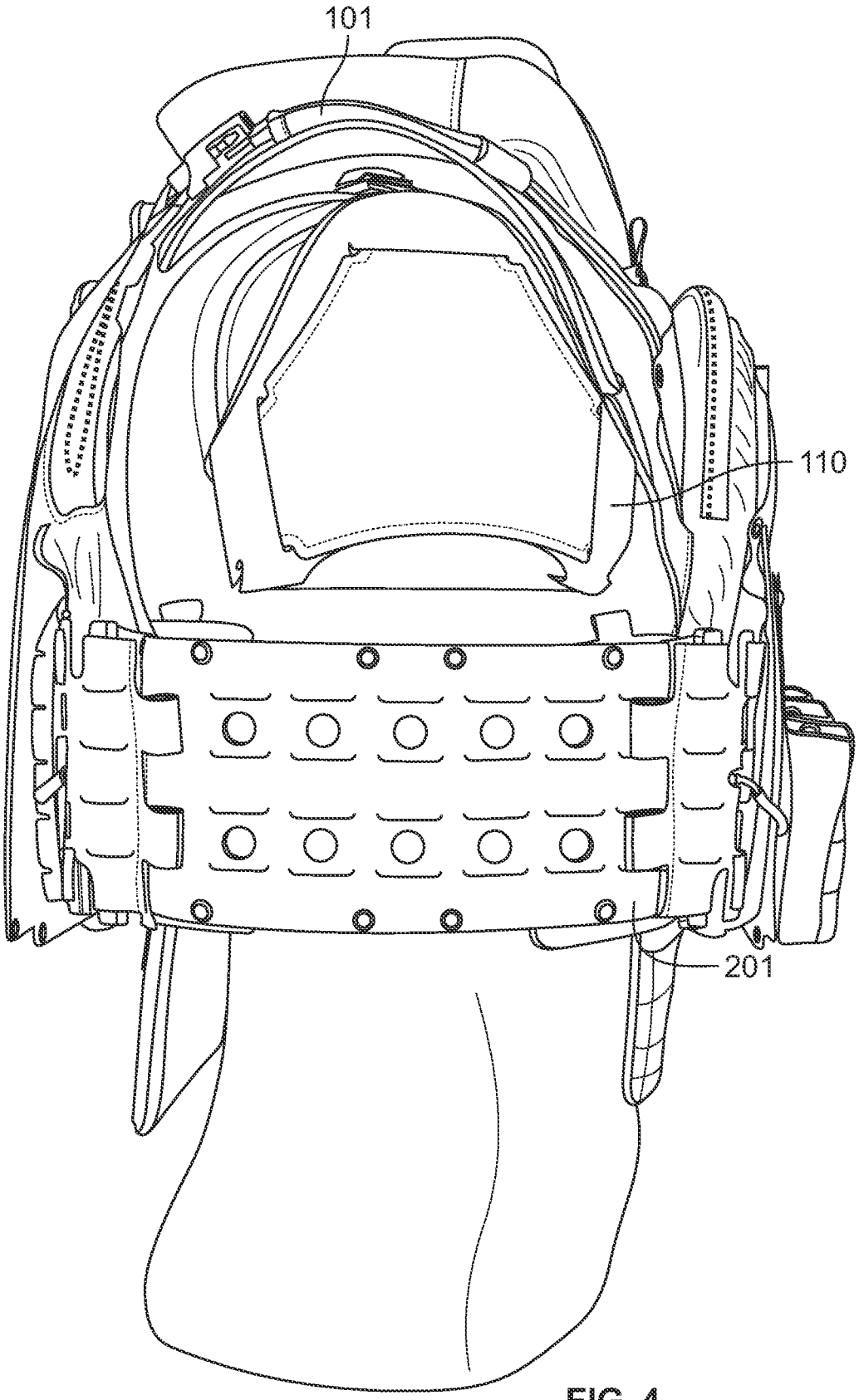
FIG. 4 is a right side view of the body armor system.
Figure 5:
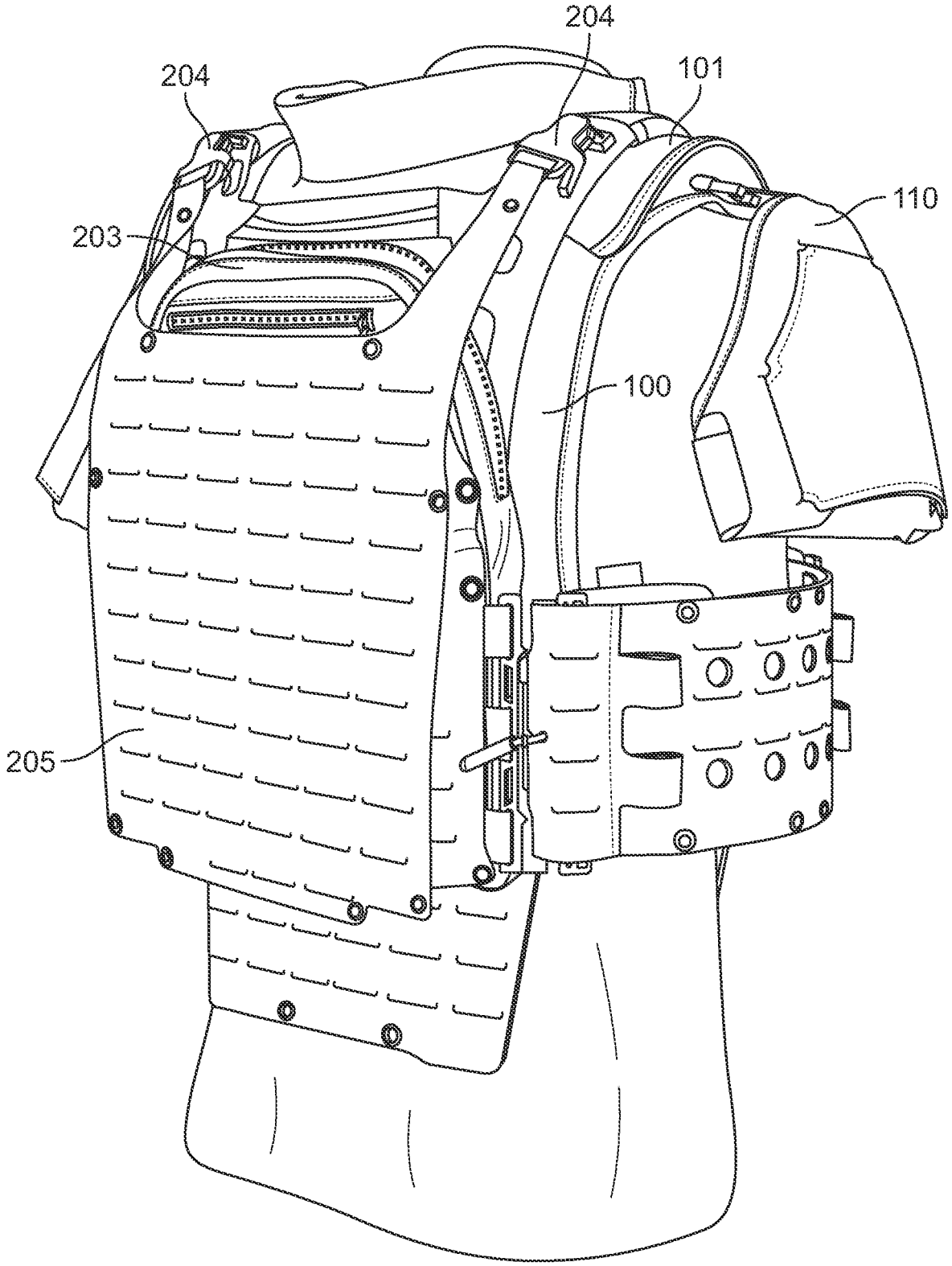
FIG. 5 is a rear isometric view of the body armor system.
Figure 6:
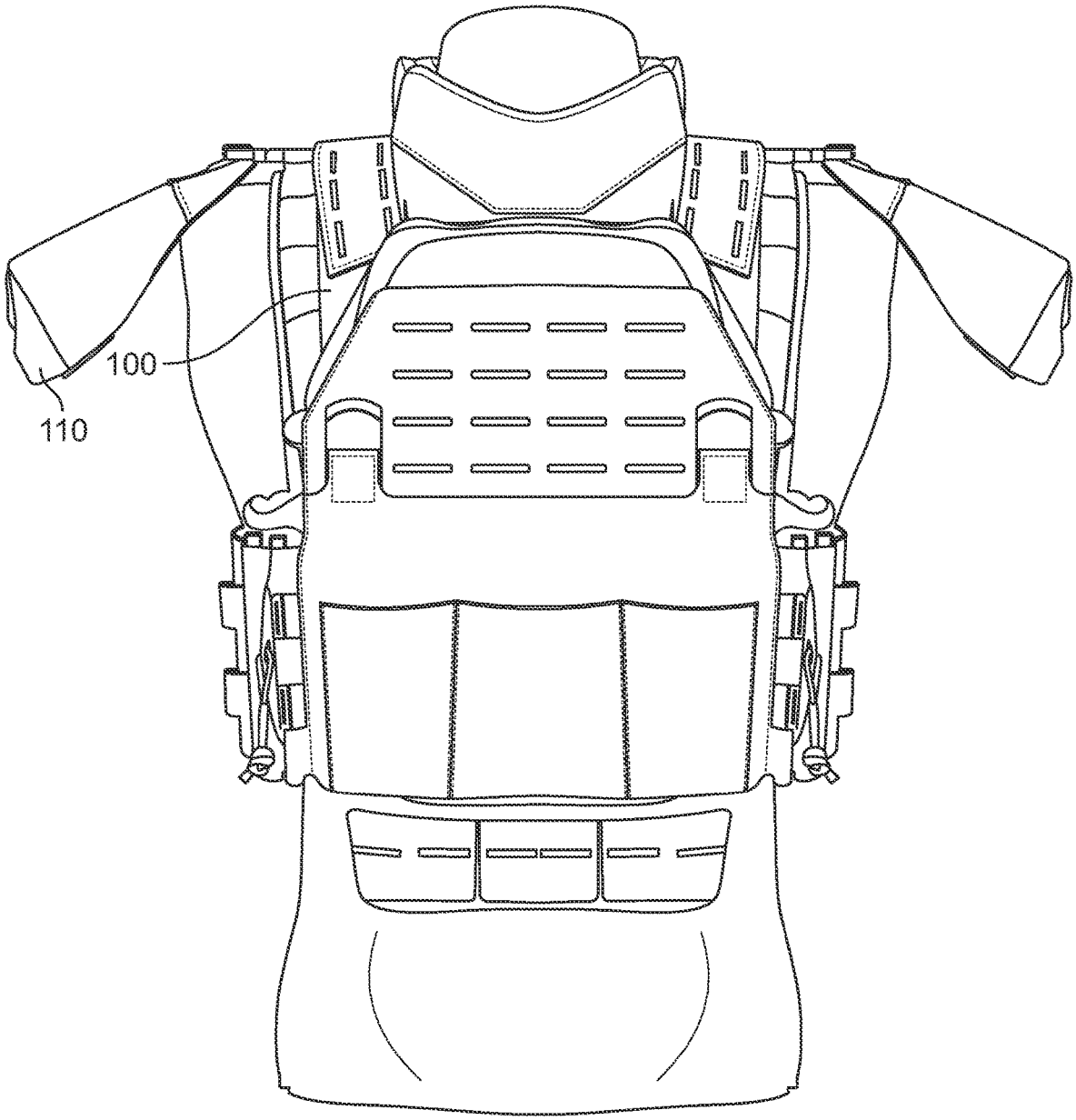
FIG. 6 is a front view of the body armor system without the shoulder suspension members.
Figure 7:
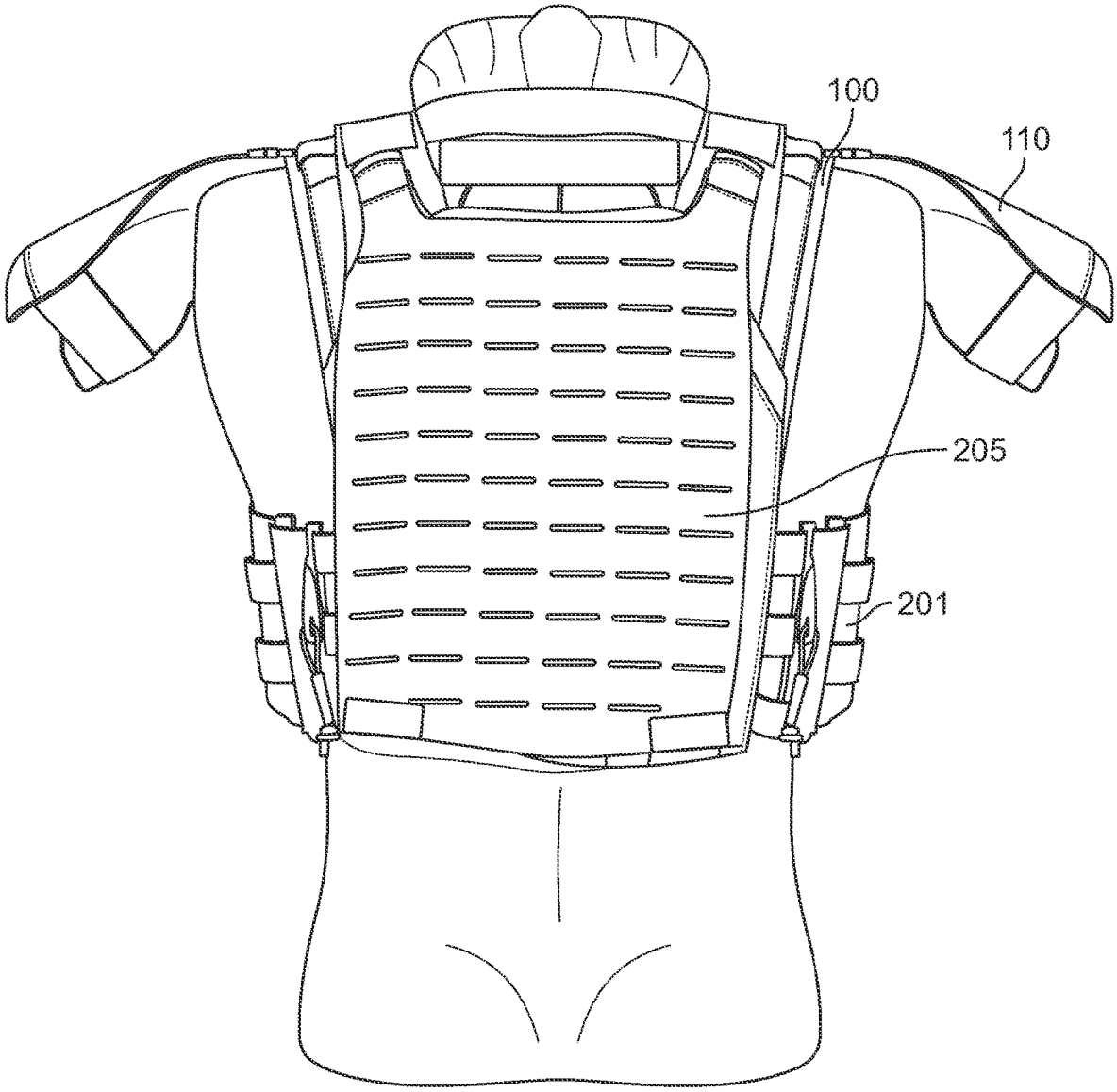
FIG. 7 is a rear view of the body armor system without the shoulder suspension members.

It will be recognized that some or all of the Figures are schematic representations for purposes of illustration and do not necessarily depict the actual relative sizes or locations of the elements shown. The Figures are provided for the purpose of illustrating one or more embodiments of the invention with the explicit understanding that they will not be used to limit the scope or the meaning of the claims.

DETAILED DESCRIPTION OF THE INVENTION

In the following description, for the purposes of explanation, numerous specific details are set forth in order to provide a thorough understanding of the badge system of the present invention. It will be apparent, however, to one skilled in the art that the badge system may be practiced without some of these specific details. Throughout this description, the embodiments and examples shown should be considered as exemplars, rather than as limitations on the badge system. That is, the following description provides examples, and the accompanying drawings show various examples for the purposes of illustration. However, these examples should not be construed in a limiting sense as they are merely intended to provide examples of the badge system rather than to provide an exhaustive list of all possible implementations of the badge system.

Specific embodiments of the invention will now be further described by the following, non-limiting examples which will serve to illustrate various features. The examples are intended merely to facilitate an understanding of ways in which the invention may be practiced and to further enable those of skill in the art to practice the invention. Accordingly, the examples should not be construed as limiting the scope of the invention. In addition, reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment. Furthermore, the particular features, structures or characteristics may be combined in any suitable manner in one or more embodiments.

The phrase "and/or," as used herein, should be understood to mean "either or both" of the elements so joined, i.e., elements that are conjunctively presented in some cases and disjunctively presented in other cases.

Body Armor System

With reference to FIGS. 1-7 shown is an embodiment a body armor system comprising an armor carrier 200 disposed over an upper protector 100. In some embodiments, the upper protector 100 comprises a soft body armor component worn over the torso which protects a portion thereof, as described below and show in FIGS. 14-18. In some embodiments, the upper protector 100 is referred to herein as a mantel and/or accessory hub. In the mantel configuration, the upper protector is disposed over the shoulders and provides protection for the upper shoulders and neck area of the wearer. The upper protector also provides structure to comfortably retain the weight of the carrier across the shoulders and upper body of the wearer. In some embodiments, the upper protector includes shoulder suspension members 101 inserted into openings on the anterior and posterior of the upper protector, about the shoulder area, which assist in supporting the weight of the armor carrier 200. In some embodiments, a deltoid guard 110 is attached to either or both sides of the upper protector. The armor carrier 200 is disposed over the upper protector 100, resting on the shoulders of the wearer and generally protects the thorax of the wearer. The system uses combinations of soft and hard armor to provide protection against blunt objects, sharp objects, ballistics, and fragmentation.

Upper Protector

Figure 8:
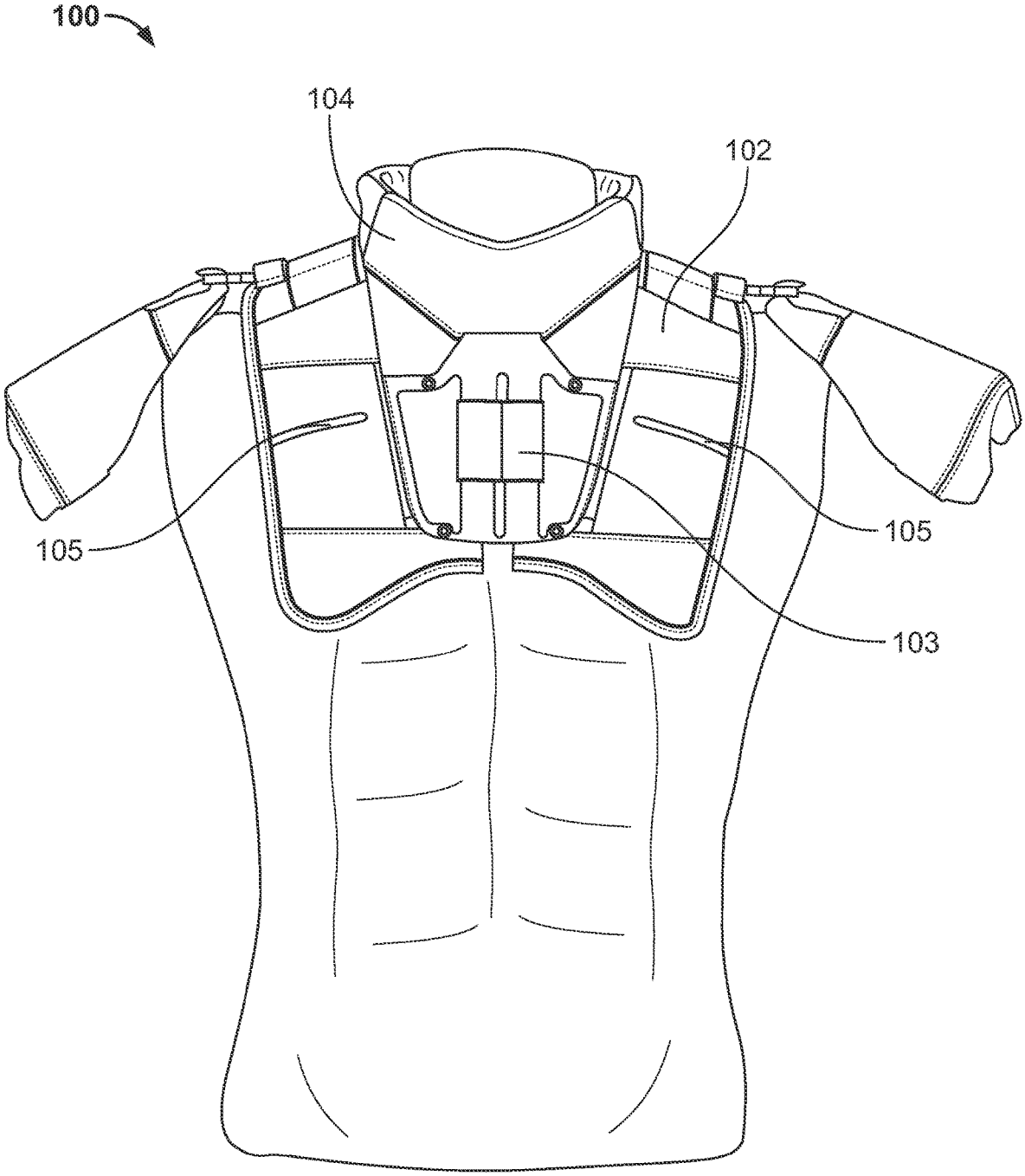
FIG. 8 is a front view of the upper protector.
Figure 9:
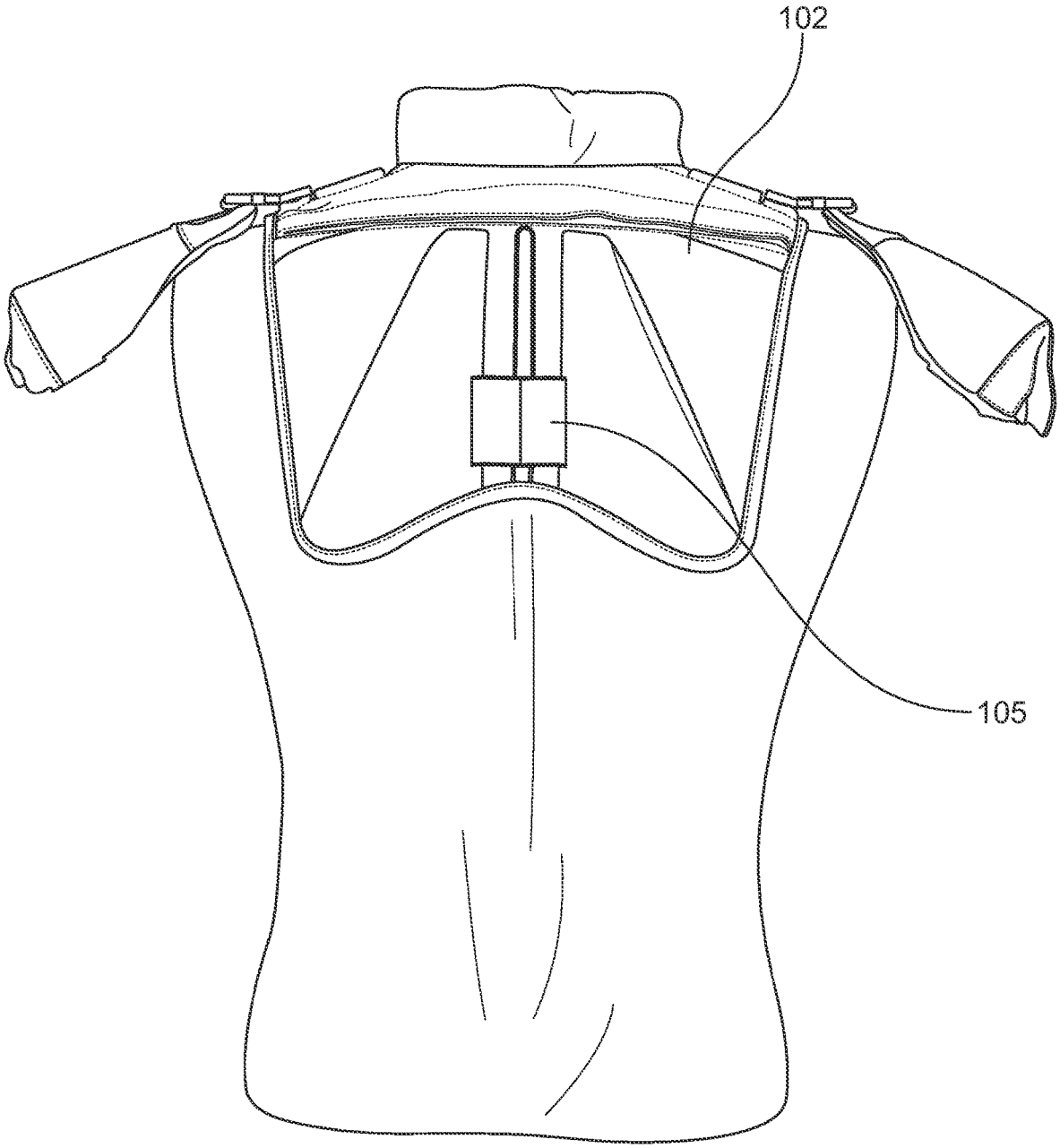
FIG. 9 is a rear view of the upper protector.

With reference to FIGS. 8-9, shown is an embodiment of the mantel 100 without the armor carrier 200. The mantel includes a primary yoke 102 which comprises the supporting structure of the protector that drapes at least partially over the thorax (upper back and upper chest) of the wearer. The yoke 102 retains a throat guard 104 which is inserted at its edges into corresponding openings on the yoke 102. At the center of either or both of the front and back of the yoke 102 is a sliding attachment point 103. In some embodiments, the attachment point 103 comprises hook and loop fastener or another removable fastener such as a snap or buckle which engages a corresponding attachment point on the inside of the armor carrier 200. The attachment point 103 is configured to slide in a vertical direction along the upper protector 100 in order to allow the armor carrier 200 to articulate relative to the upper protector 100 to maximize comfort and mobility for the wearer. Also shown are openings 105 which receive the shoulder suspension member 101 as further shown and described herein.

Deltoid Guard

Figure 13:
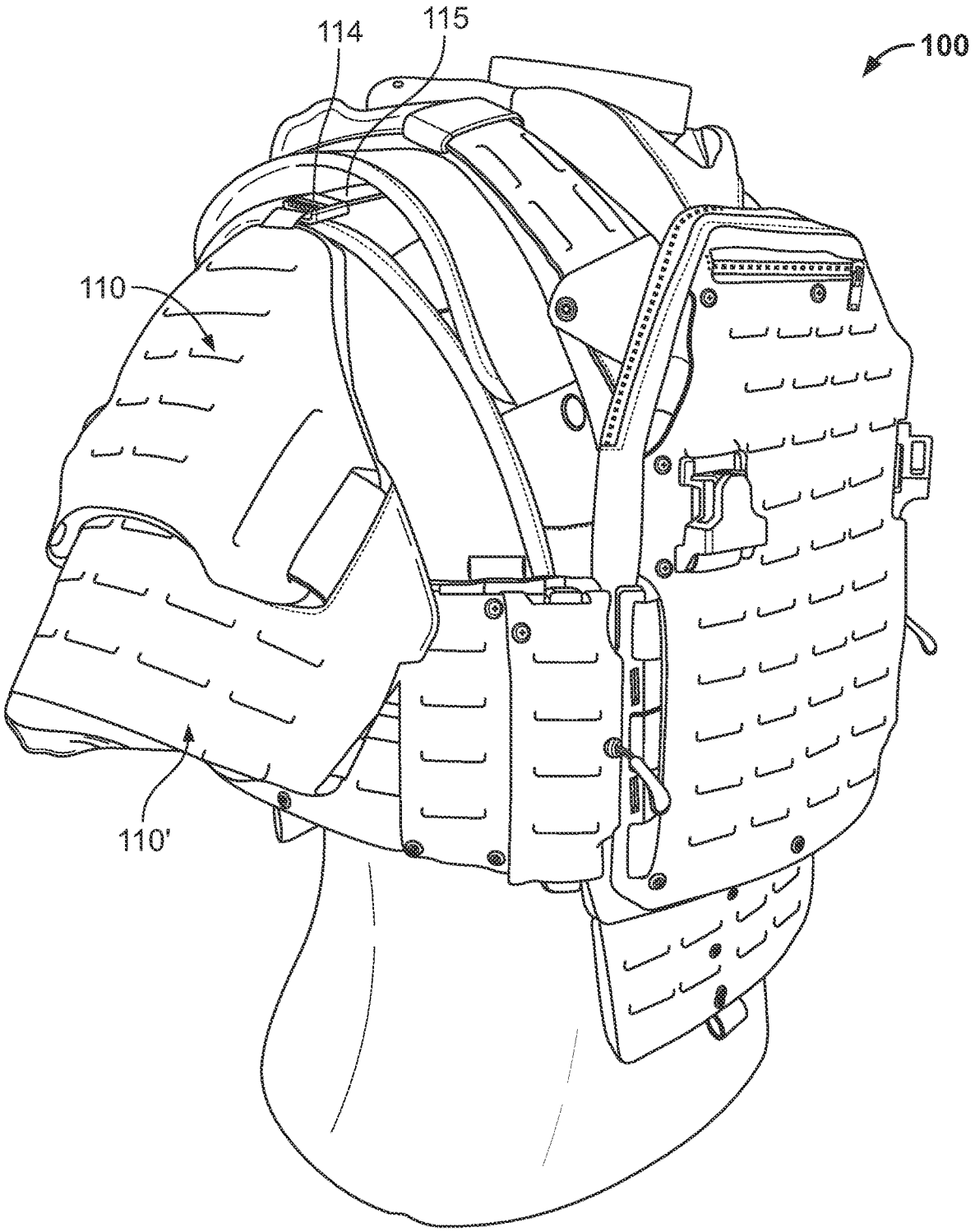
FIG. 13 shows a deltoid guard attached to the upper portion of the armor carrier.
Figure 14:
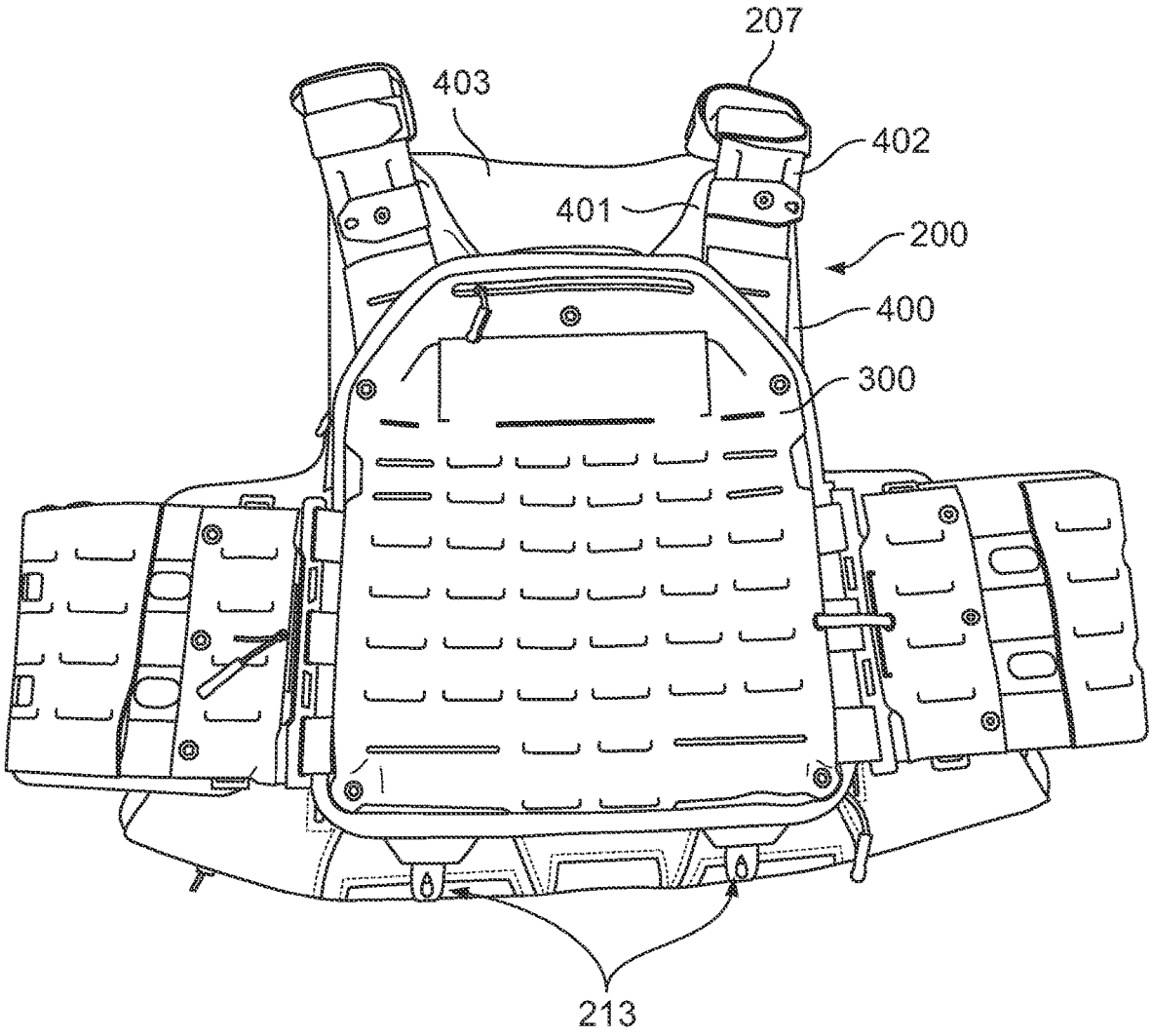
FIG. 14 shows a front view of an alternative body armor system configured as an armor carrier comprising a soft armor carrier and a plate back.
Figure 15:
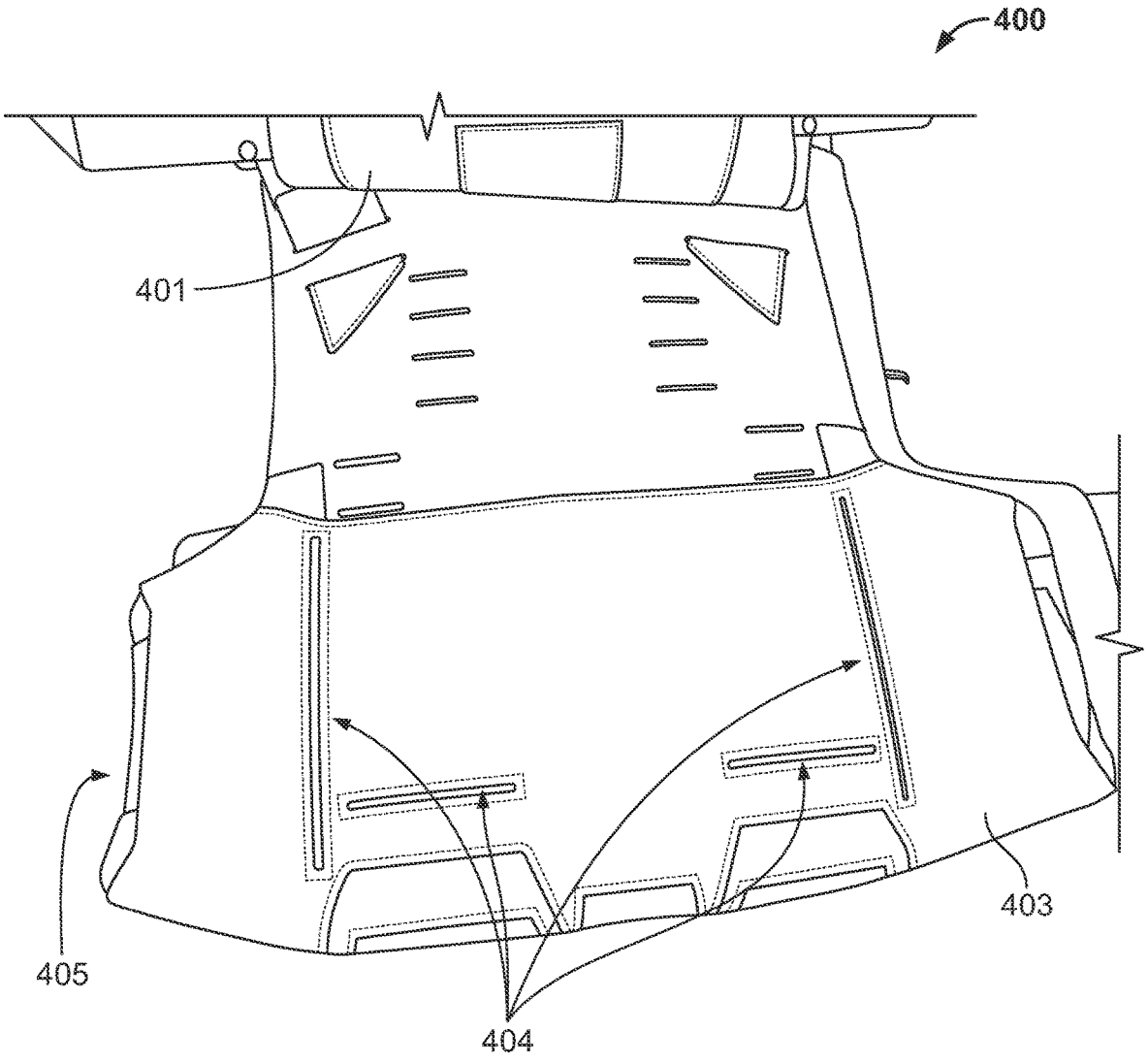
FIG. 15 shows a front view of the soft armor carrier.

FIG. 13 is a perspective view of the deltoid guard 110, which has a generally triangular or trapezoidal shape and, in some embodiments, has one or more openings 111 which receive an identification panel. The interior of the deltoid guard 110 is configured to receive and retain soft armor, hard armor, fragmentation armor, or combinations thereof. Also at the rear of the deltoid guard 110 is an expandable element, such as an elastic strap which retains the guard against the arm of the wearer. As depicted, the attachment of the deltoid guard 110 to the upper protector 100. In some embodiments, a small removable fastener 114 such as a buckle is attached at the shoulder area of the upper protector 100 which receives a corresponding fastener attached to the top of the deltoid guard 110. In other embodiments, the deltoid guard 110 may be fixed to the upper protector 100. In either configuration, an elastic material 115 may be provided at the connection to facilitate expansion and articulation of the deltoid guard 110 with respect to the upper protector 100 to aid wearer comfort.

In some embodiments, the deltoid guard 110 is relatively smaller than traditional designs and does not protect the bicep area in order to enhance mobility. However, as exemplary shown, a supplemental bicep guard 110' may be implemented, which attaches to the deltoid such that the bicep guard can articulate with respect to the deltoid guard. In some embodiments, the bicep guard 110' is disposed at least partially underneath the deltoid guard 110 and attaches either to the deltoid guard or the upper protector by a buckle, elastic, and/or wedge received in an opening on the deltoid protector and/or the upper protector. This allows for a modular, scalable arm protection system that maximizes comfort and mobility.

Armor Carrier

Figure 10:
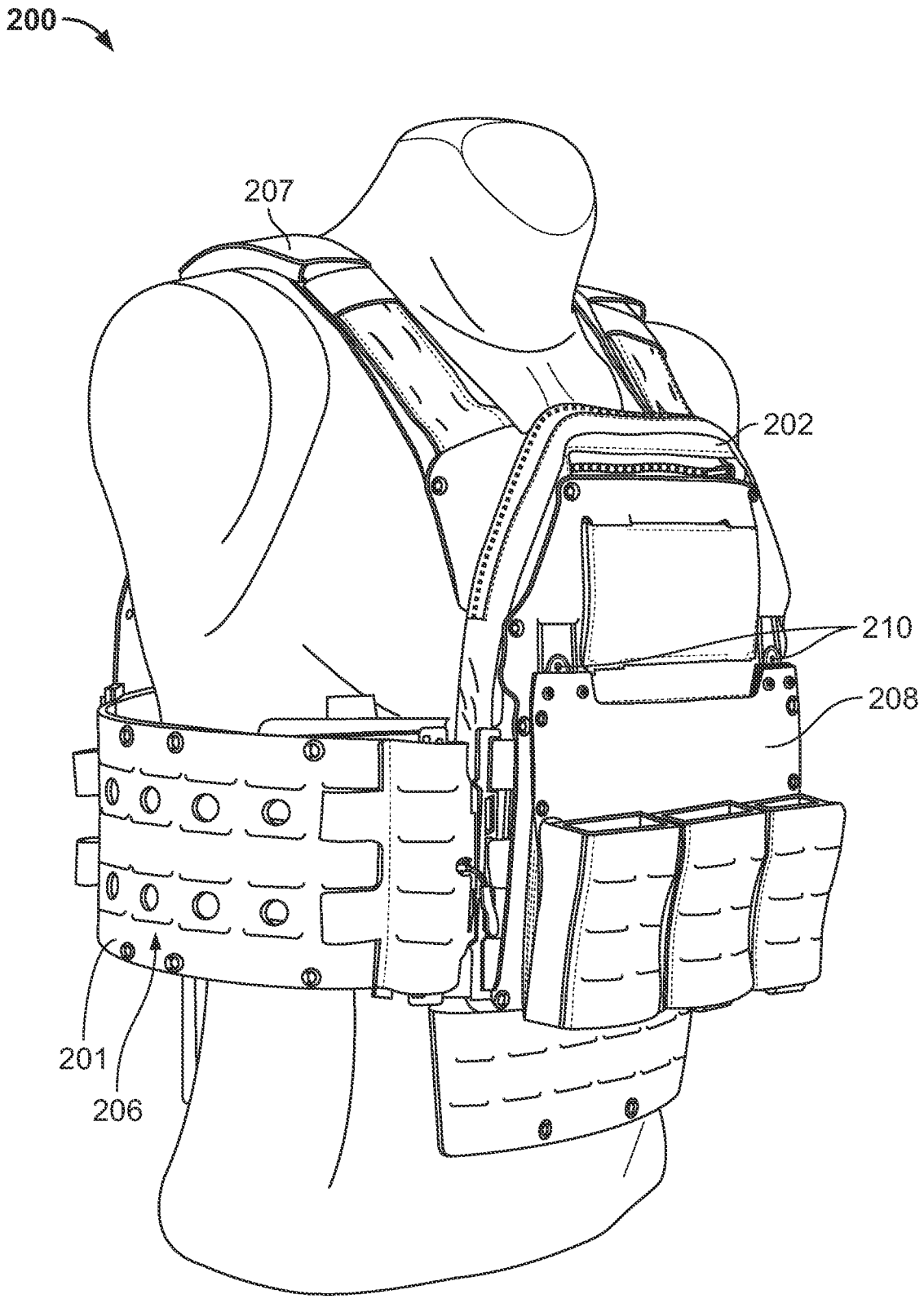
FIG. 10 is a front isometric view of the armor carrier.
Figure 11:
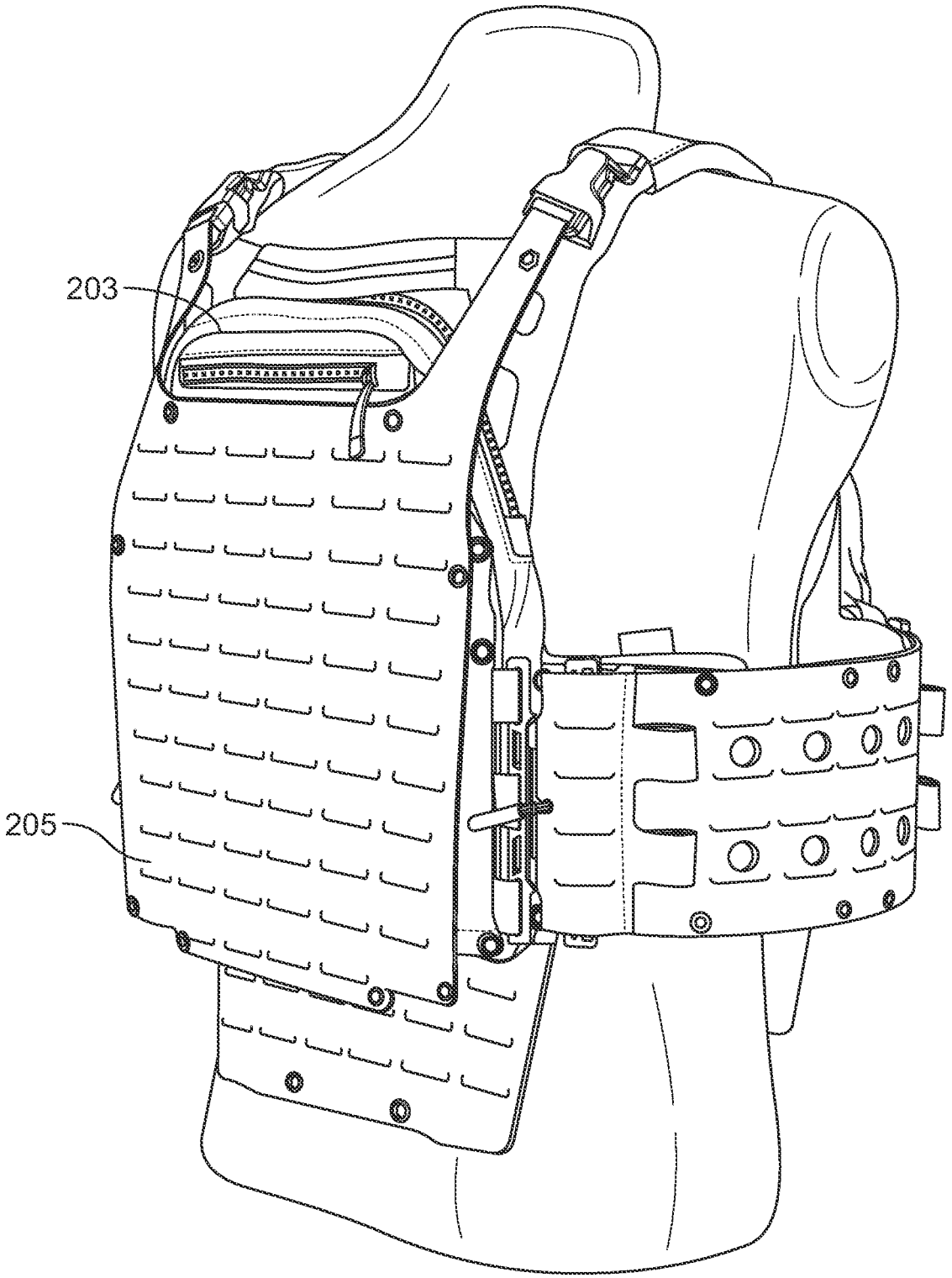
FIG. 11 is a rear isometric view of the armor carrier
Figure 12:
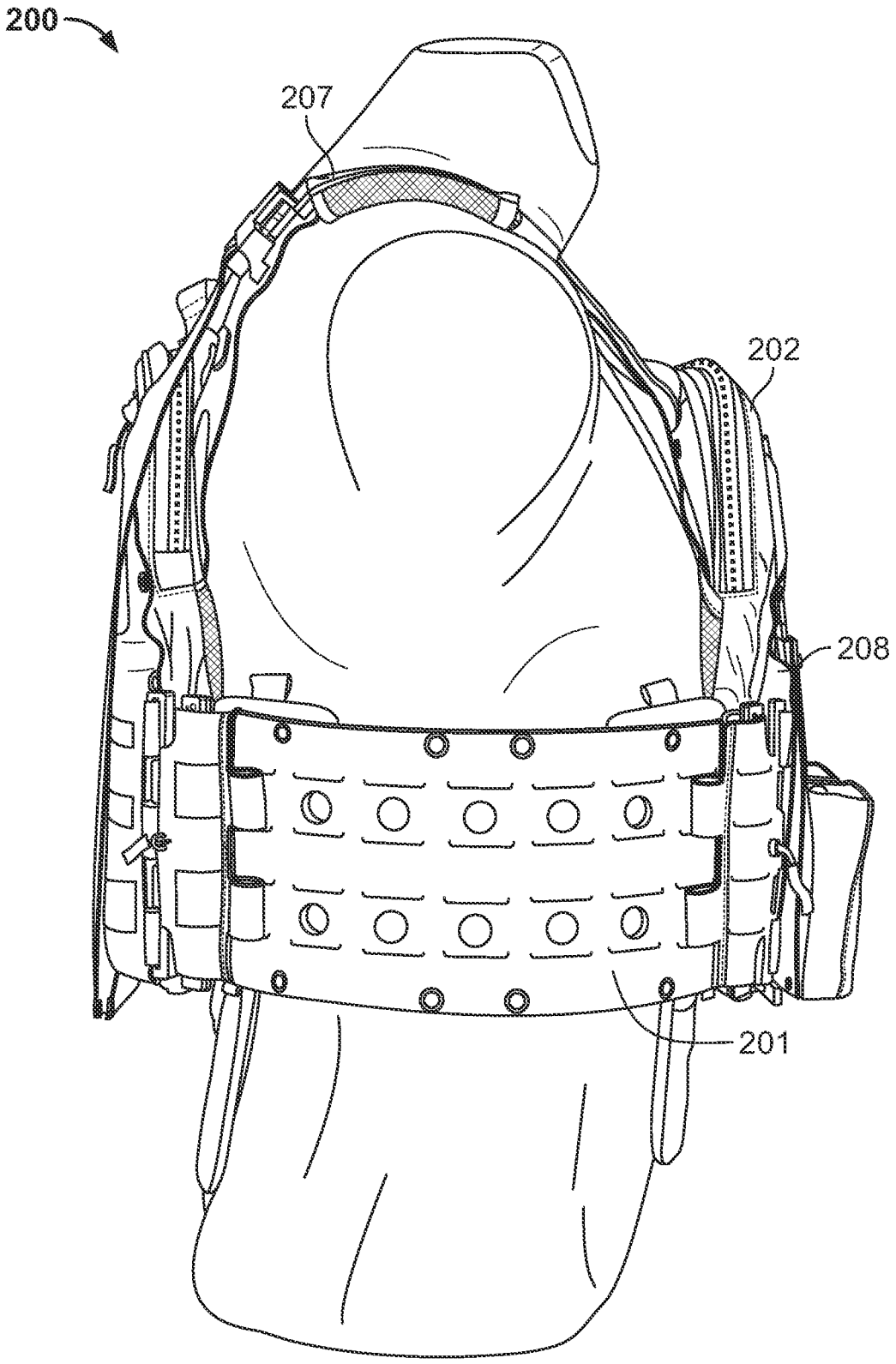
FIG. 12 is a side view of the armor carrier.

With reference to FIGS. 10-12, in some embodiments the armor carrier 200 is configured to work in conjunction with the upper protector 100, with the armor carrier 200 placed over the upper protector 100. However, the armor carrier 200 can be used independently from the upper protector 100 in modular fashion as determined by the wearer, the circumstances, and the desired protection. The armor carrier 200 includes bi-lateral shoulder straps 207 which attach the front panel 202 to the back panel 203 at the top of the shoulders. In some embodiments, the shoulder straps 207 of the armor carrier 200 are adjustable by hook and loop fastener or other removable fasteners and the free ends can be tucked into corresponding openings on the front and/or back panels 202 and 203. Also provided are bi-lateral abdomen straps 201 which attach the front panel 202 to the back panel 203 around the lower thorax or abdomen of the wearer. The bi-lateral side straps 201 comprise and/or include an accessory modular accessory system 206. The armor carrier includes an optional font flap 208 and a rear flap 205 which are removably attached to the carrier 200. In some embodiments, the rear flap 205 is attached to the armor carrier 200 at the respective shoulder straps 207 by a fastener 204, such as by a buckle.

Accessory Panel

With continued reference to FIGS. 10-13 show in a front accessory panel 208 which is removably attached to the front panel 202 of the armor carrier. The front accessory panel 208 is configured to easily align and attach to the front panel 202 using magnetic and/or mechanical attachments. In some embodiments, the inside surface of the flap 208 includes one more magnets which are configured to align and attach to corresponding magnets on the front accessory panel 208. In some embodiments, an interior aspect of the accessory panel 208 includes a raised wedge 211 which is received in a corresponding opening on the armor carrier, as shown in FIG. 36. In some embodiments, the wedge may be located on the armor carrier with the corresponding opening provided on the accessory panel 208.

In some embodiments, the top edge of the front accessory panel 208 includes one or more rigid attachment members or fasteners 210 (buckles, clasps, or prongs) that are retained in corresponding openings on the upper portion of the front panel 202 of the armor carrier 200. In some embodiments, the rigid attachment member or fastener 210 is configured to enter through an connect with an opening designed to secure accessories, such as a 1"-1.5" opening on the armor carrier 200 or an accessory, a laser cut opening, a MOLLE webbing system-compatible opening. This attachment configuration assures that the front accessory panel 208 is aligned and secured with respect to the front panel 202 for ease of attachment and use.

Modular Accessory System

FIG. 12 shows a modular accessory system 206 on the side straps 201 of the armor carrier. One or more spaced-apart rows of apertures are provided, which can be used as mounting points for accessories such as sheaths, holsters, and the like, which accessories have corresponding snaps that fit inside the apertures. In some embodiments, the modular accessory system 206 facilitates the attachment of sliding or moveable accessories. The accessories may be attached by any male-female fitting that passes through the apertures.

Plate Bag and Soft Amor Panel

With reference to FIGS. 14-18, in some embodiments, the armor carrier 200 comprising a plate bag 300 and a soft armor carrier 400 is generally shown. The soft armor carrier 400 comprises at least one panel and is donned over the shoulders of a wearer and provides protection to the mid-section, including the torso of the wearer. The soft armor carrier 400 is also designed and configured to comfortably retain the weight of the plate bag 300 across the shoulder and upper body of the wearer. For instance, in some exemplary embodiments the soft armor carrier 400 comprises shoulder straps 402 depending from a front panel 401 and rear panel 403, and respective side panels 405 (FIG. 5) extending from the rear and front panels 403, 401 that engage one another. In some embodiments, either or both of the front panel 401 and the rear panel 403 comprise a relatively flexible or soft ballistic material and, in some embodiments, comprise ballistic material encased in a cover.

The soft armor carrier 400 in one exemplary embodiment may substantially match the shape and outline contours of the plate bag 300. In some embodiments, the plate bag 300 is worn over the sides of the soft armor carrier 400 and thus the respective size and shape may differ. In an alternative embodiment, the soft armor carrier 400 is devoid of shoulder straps 402 with the front panel 401 and rear panel 403 being independent members that are removably attachable to the plate bag 300.

Figure 16:
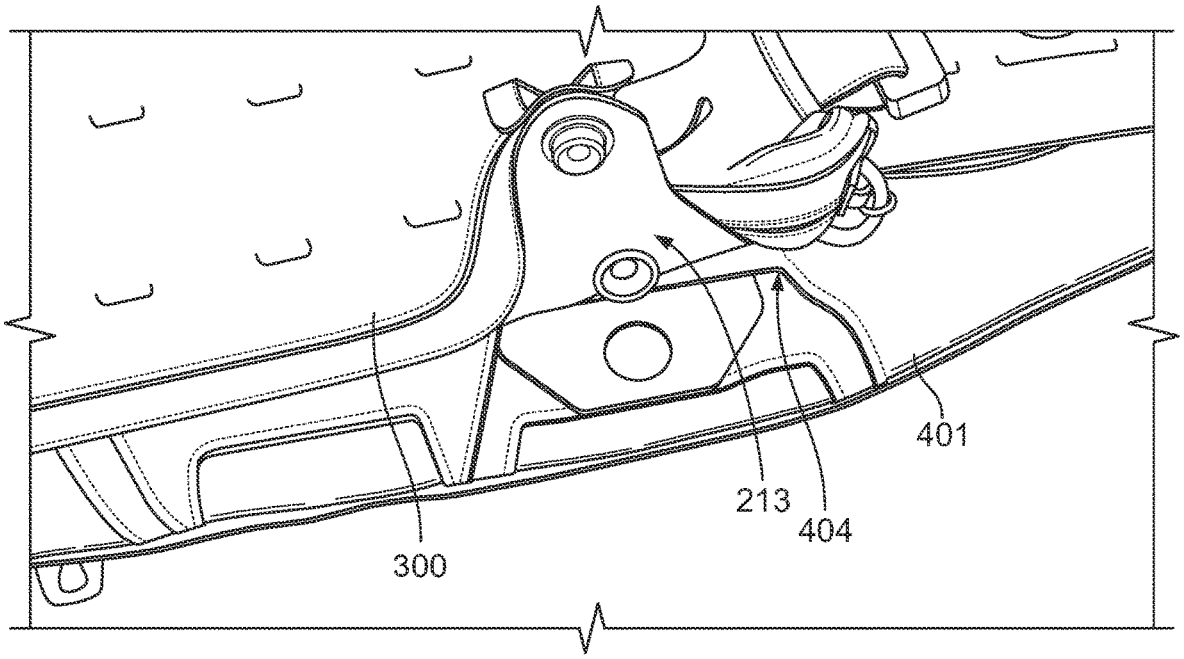
FIG. 16 shows an exemplary attachment fitting that is usable to secure the plate bag to the soft armor carrier.
Figure 17:
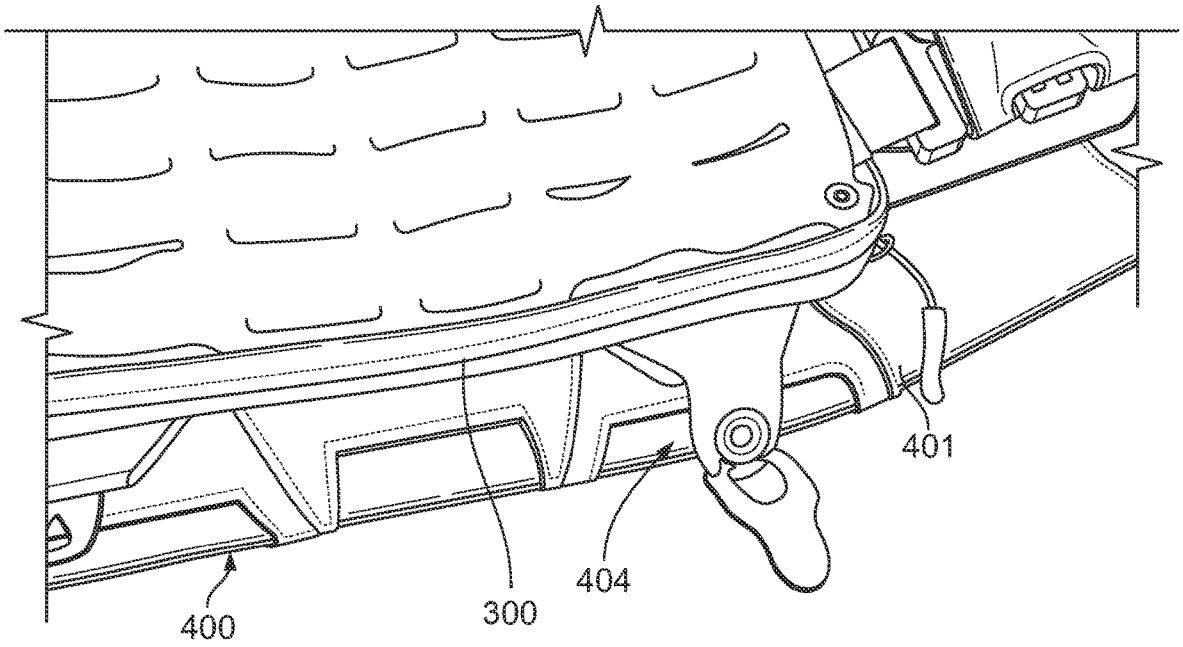
FIG. 17 shows an exemplary embodiment of the attachment fitting used to secure the plate bag to the soft armor carrier.

The soft armor carrier 400 is designed and otherwise configured to be removably secured or permanently secured to the plate bag 300. In one exemplary embodiment, comprising the removable securement of the soft armor carrier 400 to the plate bag 300, the shoulder straps 402 and the front panel 401 and rear panel 403 of the soft armor carrier 400 are removably securable to the corresponding shoulder straps 207 and front and rear panels of the plate bag 300. In this exemplary configuration, the soft armor carrier 400 includes one or more openings 404 that are sized and otherwise configured to interact with attachment fittings disposed on the plate bag 300 to secure the soft armor carrier 400 to the plate bag 300 and/or other accessory systems described herein. For example, the openings 404 of the soft armor carrier 400 extending parallel to the substantially horizontal side boundaries of the soft armor carrier 400 may be utilized to secure the modular accessory system 201 of the plate bag 300 to the soft armor carrier 400. The openings 404 extending normal to the horizontal boundary of the soft armor carrier 400, however, may be used to secure a bottom portion of the front and rear panel of the soft armor carrier 400 to the plate bag 300. As shown in FIGS. 16 and 17, the openings in the soft armor carrier 400 interact with attachment fittings 213 disposed around the outer peripheral of the plate bag 300. The plate bag 300 may comprise attachment fittings 213 that include but are not limited to a snap fitting, buckle, button, D-ring, a quick-release mechanism, clasp, ratchet mechanism, zip fastener or the like that allows for the plate bag 300 be removably secured to the soft armor carrier 400 (e.g., the front panel 401). In an alternative embodiment, the plate bag 300 may be permanently affixed to the soft armor carrier 400 via stitching, liquid stitching, adhesives, or any method used to bind two fabrics together. In another exemplary embodiment, the shoulder straps 402 of the soft armor carrier 400 are adjustably attached to the front panel 401 and rear panel 403. Meaning, the length of the straps can be adjusted to custom fit the wearer. Alternatively, the shoulder straps 402 are integrated to the front panel 401 and rear panel 403 of the soft armor carrier, and the soft armor carrier 400 is provided in different size configurations, e.g., small, medium, large, etc.

Although the plate bag 300 is removably secured to the soft armor carrier 400 in more than one method, an exemplary method of attachment is shown in FIG. 17. In this exemplary embodiment, the attachment fitting 213 comprises an elongated member that includes a locking head that is fed through a slit opening 404 of the soft armor carrier 400 and secured to itself, thereby securing the plate bag 300 to the soft armor carrier 400. It is contemplated, in some exemplary embodiments, that more than one attachment fitting be utilized to secure soft armor carrier 400 to the armor carrier. However, in some instances, depending on the style of attachment fitting (e.g., a zipper), at least one attachment fitting is all that is necessary to secure the plate bag 300 to the soft armor carrier 400. In alternative embodiments, the soft armor carrier 400 may be the one that includes the attachment fitting that engages the armor carrier 300, or both the armor carrier 300 and the soft armor carrier 400 may include attachment fittings that engage one another. Accordingly, the example and description of attachment provided herein is exemplary and not limiting.

Figure 18:
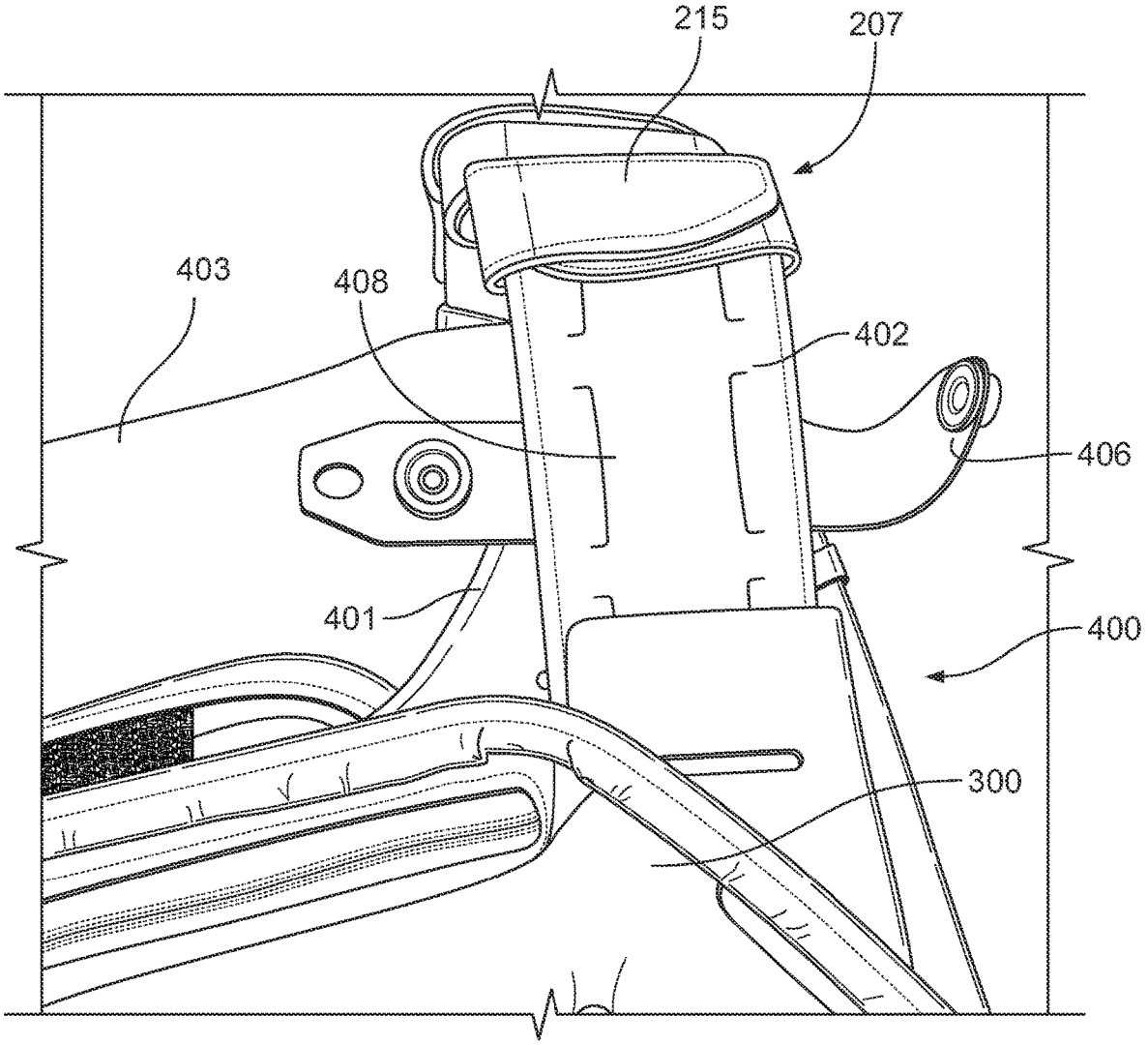
FIG. 18 shows a front view of an attachment fitting usable to secure the soft armor carrier to the shoulder straps of the plate bag.

With reference to FIG. 18, the shoulder strap 207 of the plate bag 300 and/or shoulder straps 402 of the soft armor carrier 400 may include a shoulder attachment fitting 406 disposed thereon for securing the plate bag 300 to the soft armor carrier 400. Similar to the attachment fitting disposed on the plate bag 300 as described above, the attachment fitting 406 comprises any one of a snap fitting, buckle, a quick release mechanism, button, D-ring, clasp, ratchet mechanism, or any variation or combination thereof. To secure the shoulder straps of the plate bag 300 to the soft armor carrier 400, the shoulder straps 402 of the soft armor carrier 400 is overlaid with the shoulder portion 207 of the plate bag 300. Once the shoulder strap 402 of the soft armor carrier 400 is aligned with the shoulder strap 207 of the plate bag 300, the attachment fitting 406 is used to secure both shoulder straps 402, 207 together. In one exemplary embodiment as shown in FIG. 18, the attachment fitting may comprise a snap fitting member that includes a male and female member that wraps around the shoulder straps and secures them together. In an alternative embodiment, the male and female members may be woven through slits or openings 408 disposed on the shoulder strap 402 of the soft armor carrier 400. In yet another alternative embodiment, the shoulder straps 402 of the soft armor carrier 400 and the shoulder straps 207 of the plate bag 300 may be permanently secured by any one or combination of the methods provided hereinabove. In the event a non-permanent attachment method is utilized, like the example shown in FIG. 18, the attachment fitting also functions as a mechanical stopper to prevent unwanted sliding of the soft armor carrier 400 about plate bag 300. For instance, if the shoulder strap 402 of the soft armor carrier 400 begins to slide upwardly, the attachment fitting 406 will ride upwardly until it makes contact with the armor carrier's cable management device 215. If the shoulder strap 402 of the soft armor carrier 400 begins to slide downwardly, the attachment fitting 406 will ride downwardly until it makes contact with the armor carrier's front panel 401. In either direction, the soft armor carrier 400 is impeded from sliding a substantial amount or becoming detached from the plate bag 300. The inability for the shoulder strap 207 of the plate bag 300 to be detached or misaligned with the shoulder strap 402 of the soft armor carrier 400 also makes it more comfortable for the wearer to wear both items simultaneously.

In some embodiments, it is also contemplated that the armor carrier 200 be used in conjunction with the upper protector 100, as described herein above in greater detail, that is disposed over the shoulders of a wearer and provides protection for the upper shoulders and neck area of the wearer and an armor carrier 200, or any combination thereof. In this exemplary configuration, the shoulder straps 402 of the soft armor carrier 400 engage the shoulder suspension members of the upper protector. Engagement of the shoulder straps 402 with the shoulder suspension members of the upper protector can be done through a mechanical fastener, for example as the ones described herein above. Alternatively, the shoulders straps 402 of the soft armor carrier 400 can simply rest over the shoulder suspension members of the upper protector and frictionally engage under the weight of the soft armor carrier and armor carrier, securing the soft armor carrier to the upper protector.

Materials

It is appreciated and understood that the body armor system described herein can be of a multi-material construction. In some embodiments, the fabrics that face inward toward the wearer or otherwise come in contact with the body of the wearer, such as the collar, are composed of a no-snag pack cloth or nylon material. This avoids snagging on rough skin or facial hair. In some embodiments, the body armor system utilizes rivets or grommets as a supplement or replacement for bar tacks or other sewing connections to minimize the amount of visible traditional stitching which can snag and otherwise wear out over time. Rivets and grommets also improve manufacturing tolerances and ease of manufacturing in general, as less manual sewing is required and the unit can be more easily built from a template.

As referred to herein, soft body armor, or soft ballistics, refer to a relatively soft and flexible but strong material, such as Kevlar or polyethylene, inserted into or otherwise forming a garment (or portion thereof) worn by a user for protective purposes. Generally, soft armor is distinguished from hard armor, as referred to herein, the latter typically presented in the form of thick, rigid plates made of firm, durable materials such as ceramic, ceramic composites, polyethylene, fibers, Kevlar, steel, and the like. Hard armor plates do not readily deform or otherwise conform to the body of the wearer. In many cases, protective garments utilize a combination of soft and hard armor in order to strike a balance between wearability, comfort, and mobility on the one hand, and maximum protection on the other hand.

It is to be noticed that the term "opening" as used herein and in the claims shall be deemed limited as it may refer to any number of slots, slits, apertures, channels, covered areas, or the like. It is to be noticed that the term "comprising," used in the claims, should not be interpreted as being limitative to the means listed thereafter. Thus, the scope of the expression "a device comprising means A and B" should not be limited to devices consisting only of components A and B. It means that with respect to the present invention, the only relevant components of the device are A and B. Put differently, the terms "including", "comprising" and variations thereof mean "including but not limited to", unless expressly specified otherwise.

Similarly, it is to be noticed that the term "coupled", also used in the claims, should not be interpreted as being limitative to direct connections only. Thus, the scope of the expression "a device A coupled to a device B" should not be limited to devices or systems wherein an output of device A is directly connected to an input of device B. It means that there exists a path between an output of A and an input of B which may be a path including other devices or means.

The enumerated listing of items does not imply that any or all of the items are mutually exclusive, unless expressly specified otherwise. The terms "a", "an" and "the" mean "one or more", unless expressly specified otherwise.

Elements of the invention that are in communication with each other need not be in continuous communication with each other, unless expressly specified otherwise. In addition, elements of the invention that are in communication with each other may communicate directly or indirectly through one or more other elements or other intermediaries.

One skilled in the art will appreciate that the present invention can be practiced by other than the above-described embodiments, which are presented in this description for purposes of illustration and not of limitation. The specification and drawings are not intended to limit the exclusionary scope of this patent document. It is noted that various equivalents for the particular embodiments discussed in this description may practice the invention as well. That is, while the present invention has been described in conjunction with specific embodiments, it is evident that any alternatives, modifications, permutations and variations will become apparent to those of ordinary skill in the art in light of the foregoing description. Accordingly, it is intended that the present invention embrace all such alternatives, modifications and variations as fall within the scope of the appended claims. The fact that a product, process or method exhibits differences from one or more of the above-described exemplary embodiments does not mean that the product or process is outside the scope (literal scope and/or other legally-recognized scope) of the following claims.

What is claimed is:

1. An armor carrier, comprising:

a soft armor carrier including a front panel, and a rear panel, the front panel and the rear panel including at least one opening; and a plate bag disposed over the soft armor carrier;

wherein the plate bag is removably secured to the soft armor carrier via at least one attachment fitting on the plate bag that engages with the at least one opening on the soft armor carrier, and wherein the at least one opening on the soft armor carrier is disposed substantially proximate to a bottom end of the front panel and the rear panel of the soft armor carrier.

2. The armor carrier of claim 1, wherein the plate bag is removably secured to the soft armor carrier without hook and loop.

3. The armor carrier of claim 1, wherein the attachment fittings include a quick-release mechanism for detaching the plate bag from the soft armor carrier.

4. The armor carrier of claim 1, wherein the attachment fittings are disposed substantially proximate to a lower peripheral end of the plate bag.

5. The armor carrier of claim 4, wherein the attachment fittings include an elongated member with an attachment head, the elongated member configured to be fed through an opening on the soft armor carrier and secured via the attachment head.

6. The armor carrier of claim 5, wherein the attachment head includes a male and female fitting.

7. The armor carrier of claim 1, wherein the attachment fittings are disposed on a front panel and a rear panel of the plate bag.

8. The armor carrier of claim 1, wherein the soft armor carrier does not impede removable attachment of one or more accessories to the plate bag.

9. The armor carrier of claim 1, wherein the soft armor carrier is permanently affixed to the plate bag.

10. The armor carrier of claim 1, wherein the soft armor carrier includes a pair of shoulder straps adjustably attached to respective top ends of the front panel and the rear panel and the shoulder straps are removably securable to a pair of shoulder straps of the plate bag or a pair of shoulder suspension members of an upper protector.

11. The armor carrier of claim 1, wherein either or both of the front and rear panels include ballistic material.

12. An armor carrier, comprising:

a soft armor carrier including a front panel, and a rear panel, the front panel and the rear panel including at least one opening; and a plate bag disposed over the soft armor carrier;

wherein the plate bag is removably secured to the soft armor carrier via at least one attachment fitting on the plate bag that engages with the at least one opening on the soft armor carrier, and wherein the at least one opening on the soft armor carrier comprises at least one horizontally extending slit disposed substantially proximate to a bottom end of the front panel and the rear panel of the soft armor carrier.

13. The armor carrier of claim 12, including a pair of adjustably attachable shoulder straps attached to a top end thereof.

14. The armor carrier of claim 12, wherein the plate bag is removably secured to the soft armor carrier without hook and loop.

15. The armor carrier of claim 12, wherein the attachment fittings include a quick-release mechanism for detaching the plate bag from the soft armor carrier.

16. The armor carrier of claim 12, wherein the attachment fittings are disposed on a front panel and a rear panel of the plate bag.

17. The armor carrier of claim 12, wherein the soft armor carrier does not impede removable attachment of one or more accessories to the plate bag.

18. The armor carrier of claim 12, wherein the soft armor carrier is permanently affixed to the plate bag.

19. The armor carrier of claim 12, wherein either or both of the front and rear panels include ballistic material.

20. An armor carrier, comprising:

a soft armor carrier including a front panel, and a rear panel, the front panel and the rear panel including at least one opening; and a plate bag disposed over the soft armor carrier;

wherein the plate bag is removably secured to the soft armor carrier via at least one attachment fitting on the plate bag that engages with the at least one opening on the soft armor carrier, and wherein the at least one opening on the soft armor carrier comprises at least one vertically extending slit disposed substantially proximate to opposing side ends of the front panel and the rear panel of the soft armor carrier.

21. The armor carrier of claim 20, wherein the vertically extending slit is configured to engage with an accessory system removably attachable to the plate bag.

22. The armor carrier of claim 20, including a pair of adjustably attachable shoulder straps attached to a top end thereof.

23. The armor carrier of claim 20, wherein the plate bag is removably secured to the soft armor carrier without hook and loop.

24. The armor carrier of claim 20, wherein the attachment fittings include a quick-release mechanism for detaching the plate bag from the soft armor carrier.

25. The armor carrier of claim 20, wherein the attachment fittings are disposed substantially proximate to a lower peripheral end of the plate bag.

26. The armor carrier of claim 20, wherein the attachment fittings are disposed on a front panel and a rear panel of the plate bag.

27. The armor carrier of claim 20, wherein the soft armor carrier does not impede removable attachment of one or more accessories to the plate bag.

28. The armor carrier of claim 20, wherein the soft armor carrier is permanently affixed to the plate bag.

29. The armor carrier of claim 20, wherein either or both of the front and rear panels include ballistic material.

30. An armor carrier, comprising:

a soft armor carrier including a front panel, and a rear panel, the front panel and the rear panel including at least one attachment fitting; and a plate bag disposed over the soft armor carrier, the plate bag including at least one opening disposed substantially proximate to a bottom end of a front panel and a rear panel of the plate bag;

wherein the plate bag is removably secured to the soft armor carrier via the at least one attachment fitting on the soft armor carrier engaging with the at least one opening on the plate bag.

* * * * *